US010575663B2

(12) United States Patent
Krake et al.

(10) Patent No.: US 10,575,663 B2
(45) Date of Patent: Mar. 3, 2020

(54) WALL HANGING BRACKET

(71) Applicant: UNDER THE ROOF DECORATING INC., Calgary (CA)

(72) Inventors: Kelly Krake, Calgary (CA); Liette Tousignant, Calgary (CA); Michael Kurtz, Calgary (CA)

(73) Assignee: UNDER THE ROOF DECORATING INC., Calgary (CA)

( * ) Notice: Subject to any disclaimer, the term of this patent is extended or adjusted under 35 U.S.C. 154(b) by 128 days.

(21) Appl. No.: 15/714,272

(22) Filed: Sep. 25, 2017

(65) Prior Publication Data

US 2018/0014665 A1 Jan. 18, 2018

Related U.S. Application Data

(63) Continuation of application No. 14/842,128, filed on Sep. 1, 2015, now Pat. No. 9,839,307.

(51) Int. Cl.
*A47G 1/16* (2006.01)
*A47G 1/06* (2006.01)

(52) U.S. Cl.
CPC ..... *A47G 1/16* (2013.01); *A47G 1/06* (2013.01)

(58) Field of Classification Search
CPC ..... A47G 1/16; A47G 1/06; A47G 1/1606; A47G 1/162; A47G 1/22
See application file for complete search history.

(56) References Cited

U.S. PATENT DOCUMENTS

| | | | |
|---|---|---|---|
| 1,159,813 | A | 11/1915 | Volkhardt |
| 1,340,711 | A | 5/1920 | Greenwald |
| 1,407,177 | A | 2/1922 | Stone |
| 1,496,282 | A | 6/1924 | Taylor |
| 1,633,859 | A | 6/1927 | Harvey |
| 2,010,660 | A | 8/1935 | Ferris |
| 2,204,862 | A | 6/1940 | Lehman |
| 2,639,109 | A | 5/1953 | Hoag |
| 3,265,339 | A | 8/1966 | Hushek |
| 3,514,886 | A | 6/1970 | Drakard |

(Continued)

FOREIGN PATENT DOCUMENTS

| | | |
|---|---|---|
| FR | 2674736 A1 | 10/1992 |
| FR | 2835167 | 8/2003 |

(Continued)

*Primary Examiner* — Anita M King
(74) *Attorney, Agent, or Firm* — Norton Rose Fulbright Canada LLP; Alexandre Daoust

(57) ABSTRACT

A bracket for hanging a picture frame on a supporting structure. The bracket is a one-piece member formed of plastic having a pair of legs projecting perpendicularly from a bottom surface of a base and extending at right angles with respect to each other. The legs are spaced from a peripheral edge of the base forming a V-shaped planar portion between the edge and legs. A reinforcing member extends between the pair of legs and an attachment pin mounted in the reinforcing member extends outwardly beyond a top surface of the base. A pair of securement pins in the frame legs are driven into the frame to secure the bracket in a right angle corner of the frame. A pair of attachment pins is pressed into the supporting structure to suspend the frame therefrom after two of the brackets are secured in upper right hand corners of the frame.

4 Claims, 13 Drawing Sheets

(56) References Cited

U.S. PATENT DOCUMENTS

| | | | | |
|---|---|---|---|---|
| 3,529,799 | A | 9/1970 | Schaefer | |
| 3,630,476 | A * | 12/1971 | Lococo | A47G 1/24 248/476 |
| 3,692,265 | A | 9/1972 | Barriger | |
| 3,787,937 | A | 1/1974 | Gross | |
| 3,861,639 | A | 1/1975 | Morrill | |
| 4,040,149 | A | 8/1977 | Einhorn | |
| 4,179,089 | A | 12/1979 | Parr, Jr. | |
| 4,348,826 | A | 9/1982 | Reim | |
| 4,437,639 | A | 3/1984 | Stein | |
| 4,458,873 | A | 7/1984 | Sutherland | |
| 4,606,526 | A | 8/1986 | Rabinowitz | |
| 4,689,906 | A | 9/1987 | Sherman | |
| 4,809,859 | A | 3/1989 | Chung | |
| D303,942 | S | 10/1989 | Bottcher | |
| 5,189,820 | A | 3/1993 | Komamura | |
| 5,199,681 | A | 4/1993 | Reidy | |
| 5,249,765 | A | 10/1993 | Garcia | |
| 5,255,458 | A | 10/1993 | Piel | |
| 5,265,358 | A | 11/1993 | Borod | |
| 5,279,056 | A | 1/1994 | Komamura | |
| 5,303,895 | A | 4/1994 | Hart | |
| 5,464,185 | A | 11/1995 | Hensley | |
| 5,799,429 | A | 9/1998 | Speshyock | |
| 5,947,437 | A | 9/1999 | Tate et al. | |
| 6,042,078 | A | 3/2000 | Donovan | |
| 6,439,520 | B1 | 8/2002 | Johnson | |
| 6,682,033 | B1 | 1/2004 | Cohen et al. | |
| 6,719,260 | B1 | 4/2004 | Hart | |
| 6,729,060 | B1 | 5/2004 | Rietkerk | |
| 7,313,880 | B2 | 1/2008 | Yamagishi | |
| D572,122 | S | 7/2008 | Cave | |
| 8,104,208 | B2 | 1/2012 | Schymura | |
| 8,196,889 | B2 * | 6/2012 | Sangiuliano | F16M 13/02 248/466 |
| 8,342,472 | B2 | 1/2013 | Gaudron et al. | |
| 8,632,044 | B2 | 1/2014 | Cave | |
| 8,740,171 | B2 | 6/2014 | Crescenzo | |
| 8,793,910 | B2 | 8/2014 | Froio et al. | |
| 8,898,945 | B2 | 12/2014 | Miller | |
| RE45,475 | E | 4/2015 | Schymura | |
| 9,259,105 | B2 | 2/2016 | Van Bortel | |
| D753,465 | S | 4/2016 | Marsh | |
| 9,801,477 | B2 * | 10/2017 | Krake | A47G 1/1606 |
| 10,039,394 | B2 * | 8/2018 | Pyle | A47G 1/10 |
| 2005/0006552 | A1 | 1/2005 | Giles | |
| 2007/0210234 | A1 | 9/2007 | Lin | |
| 2009/0064555 | A1 | 3/2009 | Schymura | |
| 2009/0113776 | A1 | 5/2009 | Van Bortel | |
| 2009/0193674 | A1 | 8/2009 | Megahed | |
| 2009/0294610 | A1 | 12/2009 | Paharik et al. | |
| 2012/0036754 | A1 | 2/2012 | Van Bortel | |
| 2014/0173923 | A1 | 6/2014 | Van Bortel | |
| 2017/0055730 | A1 | 3/2017 | Krake et al. | |
| 2017/0055732 | A1 | 3/2017 | Krake et al. | |
| 2017/0059084 | A1 | 3/2017 | Krake et al. | |

FOREIGN PATENT DOCUMENTS

| | | |
|---|---|---|
| GB | 1031208 | 6/1966 |
| JP | 3872881 | 1/2007 |
| JP | 2015203780 | 11/2015 |
| KR | 100541232 | 1/2006 |
| KR | 20130035592 | 4/2013 |
| WO | 8504789 | 11/1985 |

* cited by examiner

WALL HANGING BRACKET

BACKGROUND OF THE INVENTION

Technical Field

The invention relates to a bracket for hanging objects such as picture frames, mirrors, etc. onto a supporting wall or structure. More particularly, the invention relates to a bracket and method of use for supporting a wall hanging wherein the hanger is easily and quickly mounted on the picture frame and which has a protruding pin for insertion into the supporting structure for attaching the frame to the structure.

Background Information

Canvas art typically comes without an external frame in contrast to most pictures and art work which come in a frame. The canvas is stretched and stapled or glued to an internal frame usually made of wood. The size of the canvas can vary greatly but the height of the frame (i.e. the distance from the wall to the attached canvas) has several standard sizes.

There is currently a limited number of options available to hang canvas art attached to these internal frames. One is to hang the wooden frame on one or more exposed nails secured in the wall. The problem with this is that it doesn't secure the canvas and frame to the wall so it can fall off if bumped. Another option requires the installation of additional hardware on the frame. The hardware could be picture wire, D-ring hangers, a sawtooth hanger, etc. This hardware will keep the canvas on the wall more securely but prevents the frame from being flush against the wall. Also, such prior art hanging hardware is difficult to install accurately on the frame and accurate placement of the supporting structure is difficult.

Therefore the need exists for a bracket which can securely attach various types of objects such as framed members, mirrors, clocks, wall art, etc. in a substantially flush manner to a support structure with less hardware and more accurately on the structure by combining the functional characteristics of traditional hardware fixed to the frame or mounted thereon without requiring numerous hardware components attached to the frame.

SUMMARY

In one aspect, the invention may provide a bracket for mounting an object on a support structure, said bracket comprising: a base having first and second surfaces terminating in a peripheral edge; a pair of legs projecting perpendicularly from the first surface and extending at right angles with respect to each other, each of said legs being spaced from the peripheral edge of the base forming a planar portion therebetween on said first surface; at least one fastener engageable with the planar portion of the base for securing the bracket to the object; and an attachment pin extending outwardly beyond the second surface for attaching the object to the support structure.

In another aspect, the invention may provide in combination, a rectangular frame and a pair of spaced corner brackets for hanging said frame on a support structure; said frame having at least a top frame member and two side frame members forming at least two right angled corners, each of said frame members having a front surface, a rear surface and opposed inner and outer side surfaces; and a sheet of material extending across the front surfaces of the frame members; each of said brackets comprising a base having spaced first and second surfaces terminating in an outer edge; a pair of spaced legs extending perpendicularly from the second surface of the base and forming a right angle therebetween, at least one of said legs being spaced from the outer edge of the base forming a planar shelf on the second surface of the base and engageable with the top frame member to support the frame thereon, with the other of said legs engageable with a respective side frame member to position each of said brackets in one of the right angle corners; at least one fastener extending from the second surface of the base and engageable with one of the rear surfaces of the frame members to secure the bracket on the frame; and an attachment pin extending outwardly from the first surface of the base for attaching the frame to the support structure.

In another aspect, the invention may provide a method of installing a pair of brackets on a rectangular frame with a plurality of right angle corners for hanging the frame on a support structure, including the steps of: providing a bracket having a base formed with a pair of right angle leg members terminating in a right angle corner and a fastener adjacent an end of each of said leg members and an attachment pin extending from the base between the pair of leg members; placing two of the brackets on the frame, one bracket on each of a pair of frame members forming one of the right angle corners; pressing the right angled corner of each of the brackets into a respective one of the right angle corners of the frame; pressing the fasteners into the frame to secure the two brackets on the frame; and pressing the attachment pin of each bracket into a support structure to suspend the frame on the support structure free of any additional supporting hardware.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
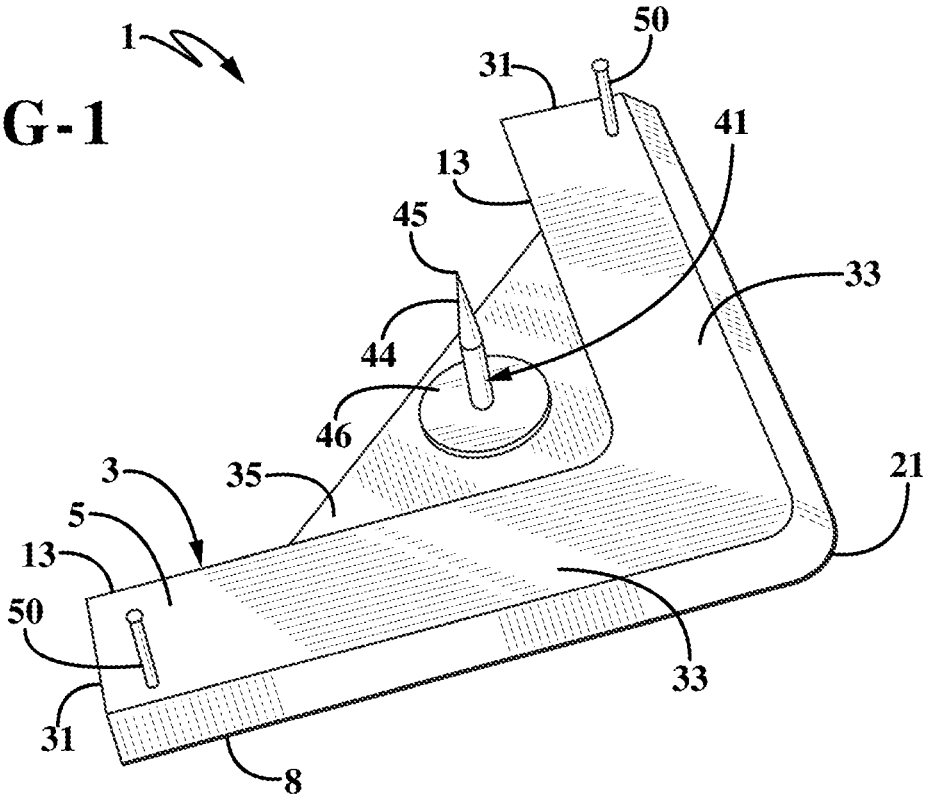
FIG. 1 is a top perspective view of the picture hanging bracket of the present invention.
Figure 2:
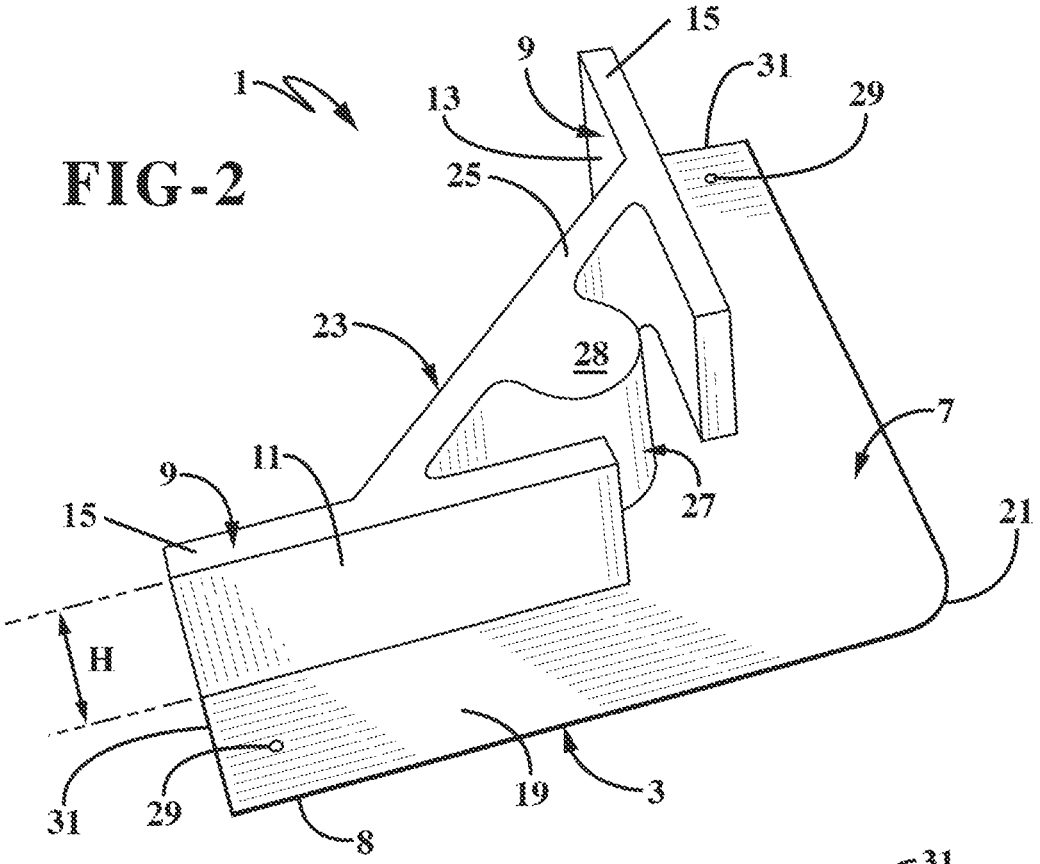
FIG. 2 is a bottom perspective view thereof.
Figure 2A:
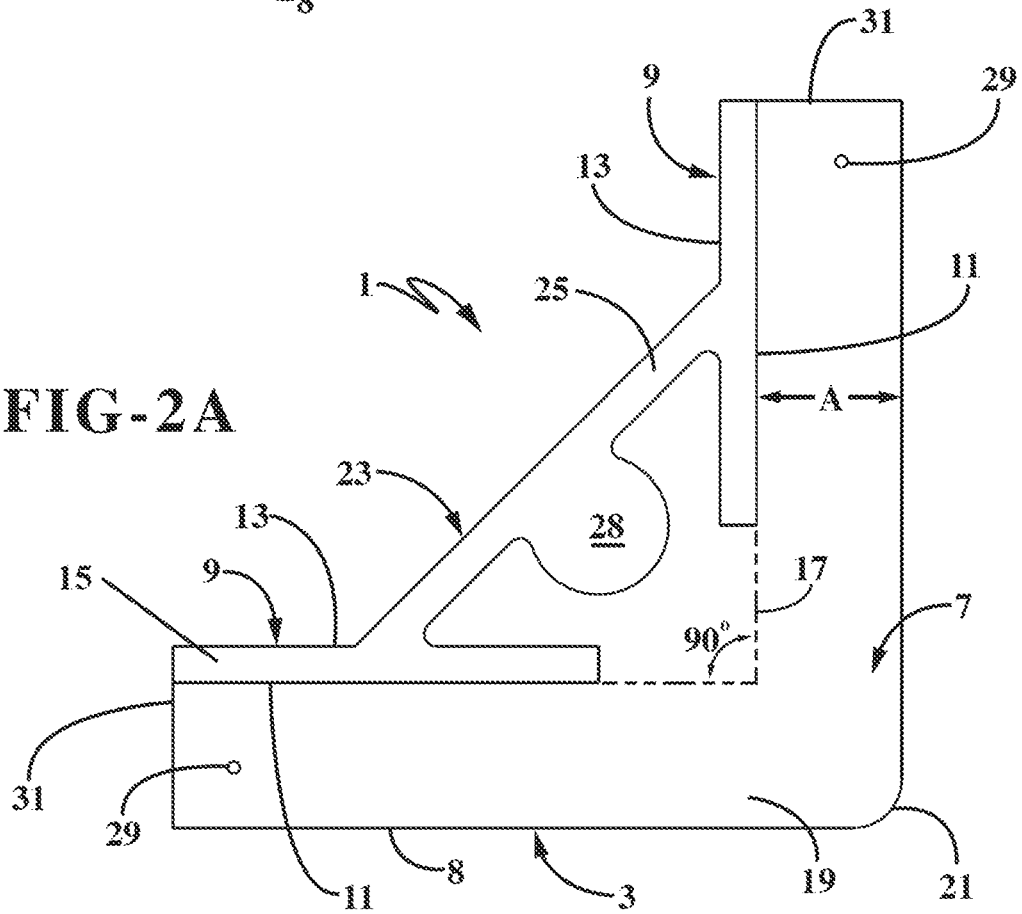
FIG. 2A is a bottom plan view without the attachment and securement pins.
Figure 3:
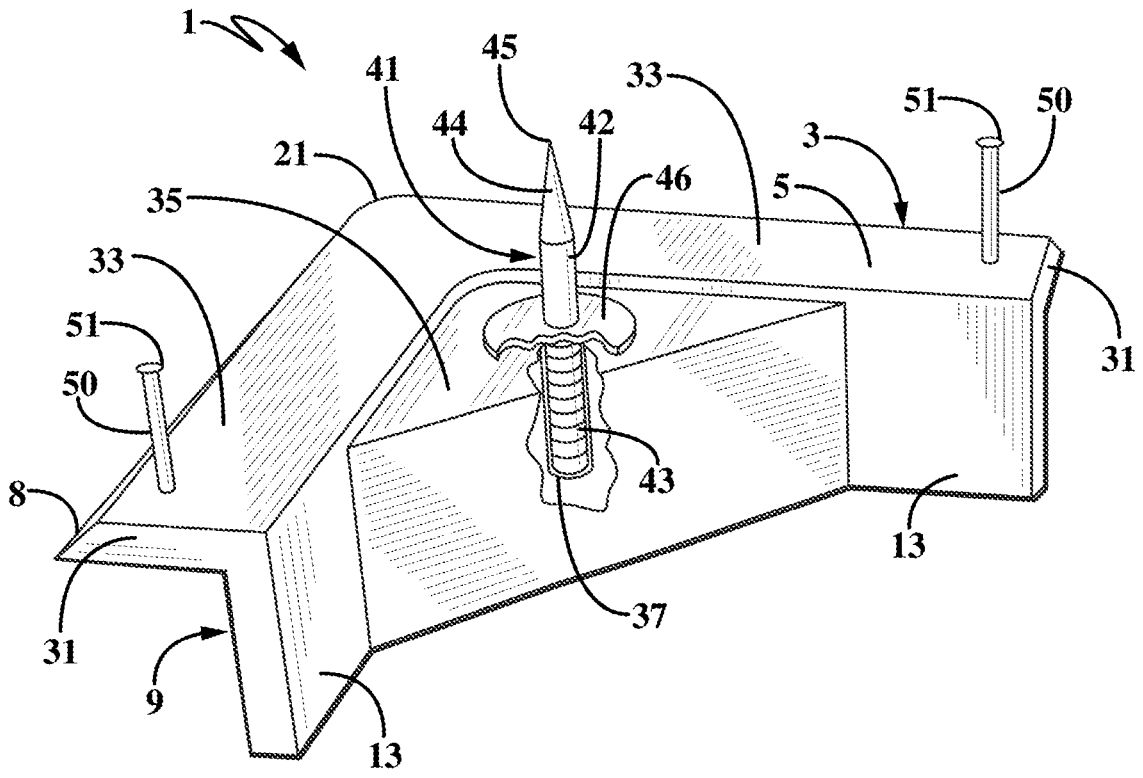
FIG. 3 is a top perspective view with portions broken away.

The hanging bracket of the present invention is indicated generally at 1, and is shown in particular in FIGS. 1-3. Bracket 1 preferably is formed of a one-piece member formed of a molded plastic material and includes a base indicated generally at 3, which includes first and second opposed surfaces hereinafter referred to as a bottom surface 7 and a top surface 5 which terminate in an outer beveled peripheral edge 8. A pair of legs, each indicated generally at 9, is formed integrally on and protects outwardly from bottom surface 7 (FIGS. 2 and 2A). Each leg 9 has a generally rectangular configuration with an outer side wall or surface 11 and an inner side wall or surface 13 terminating in a top peripheral edge 15. Legs 9 extend at 90 degrees with respect to each other forming a right angle corner, as shown by dashed lines 17 in FIG. 2A. If desired, legs 9 could merge into a V-shaped right angle corner as shown by dashed lines 17 without affecting their intended purpose and concept of the invention. Each wall 9 is spaced inwardly from peripheral edge 8 a distance A, which may be equal to the height H of each leg 9. Legs 9 being spaced from peripheral edge 8 form a generally V-shaped planar portion 19 on bottom surface 7 which is located between edge 8 and legs 9, and which terminates in an apex 21. Alternatively, bracket 1 may be formed from multiple pieces for shipping convenience without departing from the spirit of the present invention. Still further, bracket 1, although preferably manufactured from plastic, may be manufactured from a variety of materials without departing from the spirit of the present invention.

A reinforcing rib 23 is formed integrally at a rear edge of bottom surface 7 and extends upwardly therefrom and is formed integrally with legs 9. Rib 23 has a top peripheral edge 25 which preferably lies in a common plane with top edges 15 of legs 9. Preferably some type of an enlarged area or reinforcement such as a reinforcing column 27 is formed integrally with base 3 and with a portion of reinforcing rib 23 and extends upwardly from base 3 in the same direction as legs 9. Column 27 has an outer end surface 28 which also preferably lies in the same common plane with top edges 15 and 25 of legs 9 and rib 23. A pair of thru-holes 29 are formed in the V-shaped planar portion 19 of bottom surface 7 and are spaced slightly inwardly from the outer ends 31 of V-shaped planar portion 19.

Figure 1A:
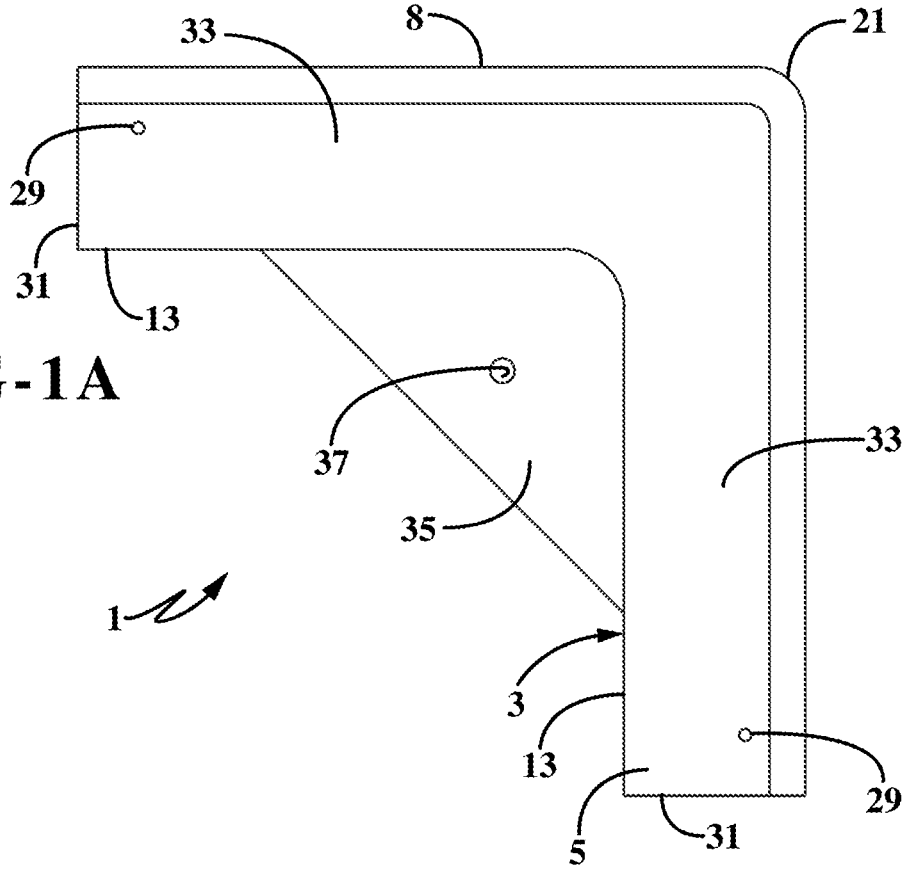
FIG. 1A is a top plan view thereof without the attachment and securement pins.

Referring particularly to FIGS. 1 and 1A, top surface 5 of base 3 has a generally V-shaped configuration formed by two planar surfaces 33 which form two legs of a triangular configuration and merge at apex 21. Planar surfaces 33 lie in a common plane and form the greater portion of top surface 5. A recessed planar portion is formed integrally with and extends diagonally between the inner edges of planar surfaces 33 forming a recessed web 35, which provides the bottom surface from which rib 23 and reinforcing column 27 extend in the opposite direction as shown in FIGS. 2 and 2A.

A hole 37 is formed in reinforcing column 27 and web 35 and receives therein an attachment pin 41, as shown particularly in FIG. 3. Attachment pin 41 includes a cylindrical shank or shaft 42 having a knurled or irregular lower end 43 which is embedded within hole 37, and a tapered top end 44 which terminates in a sharp pointed end 45. A circular generally flat disc or annular flange member 46 is mounted on shaft 42 between an irregular base or knurled end 43 and tapered end portion 44 and rests upon the upper triangular-shaped web 35 when pin 41 is embedded and fixed within reinforcing column 27.

In further accordance with the invention, a pair of securement pins 50 which may be slidably frictionally held within holes 29 until needed for securing bracket 1 on a picture frame as described later below or inserted therein when used to secure bracket 1 on a frame 55. Securement pins 50 have an enlarged blunt top end 51 and a pointed opposite end 52. Pins 50 are one type of fastener for securing bracket 1 to the back surface of a frame member. However, it is readily understood and within the scope of the invention that pins 50 can be other types of fasteners such as tacks, brads, screws, nails etc. and can even be an adhesive, a double-sided pressure sensitive adhesive pad or similar attachment device or fastener. Also, the frame can have a certain cross-section which snaps into a complementary member formed on the bracket to secure the bracket in the corner of the object being suspended thereby.

Figure 5:
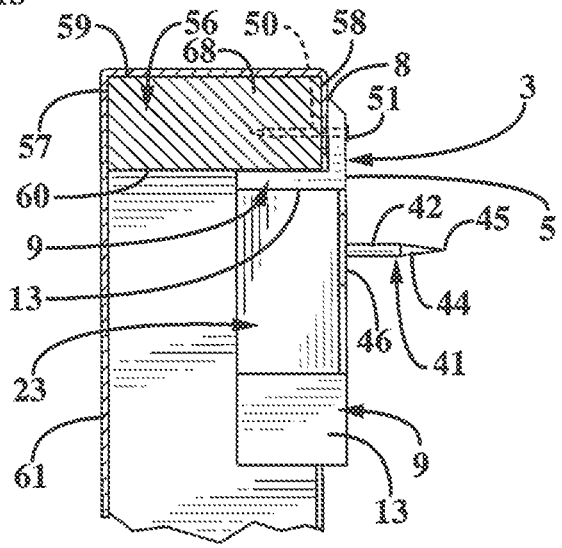
Figure 6:
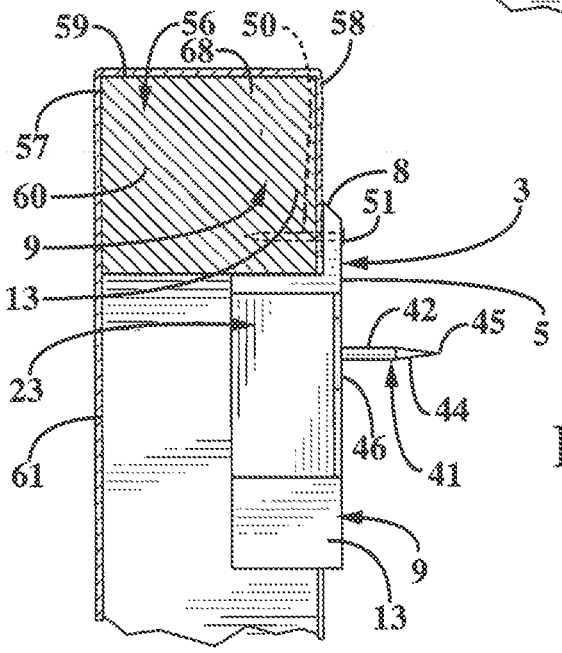
FIG. 6 is a view similar to FIGS. 4 and 5 showing the bracket attached to a different size frame.
Figure 7:
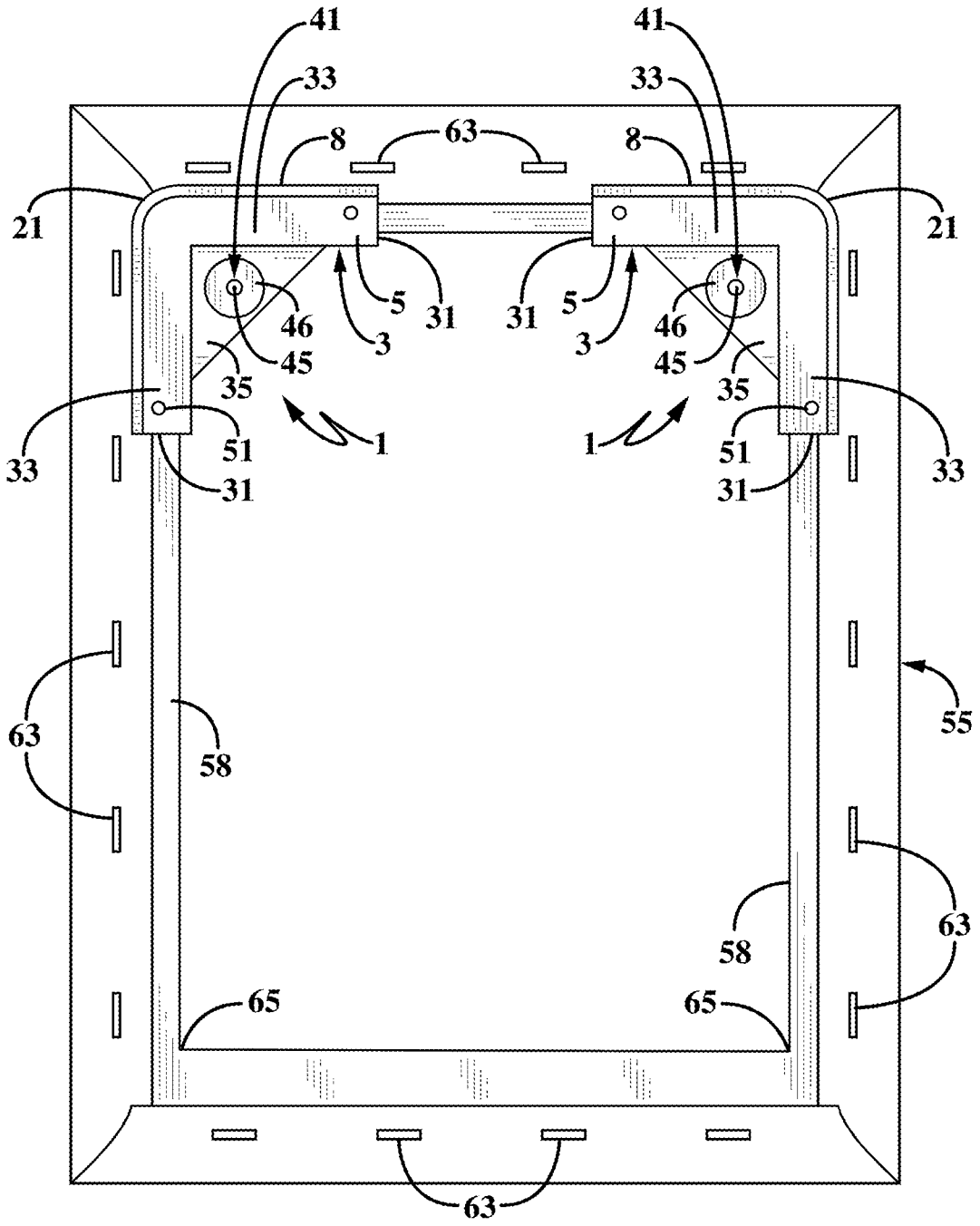
FIG. 7 is a rear plan view of two of the hanging brackets installed on a piece of canvas art.

The method of installing bracket 1 on a picture frame 55, and in particular a canvas picture frame, is best understood with references to FIGS. 4-7. A usual canvas art frame 55 will be rectangular formed by four frame members, each indicated generally at 56, which usually will have a rectangular cross-sectional configuration having a front surface 57, a rear surface 58 and outer and inner side surfaces 59 and 60. Frame members 56 will usually be formed of wood for most canvas art internal frames. The canvas art 61 is stretched over the front surfaces 57 of the four frame members and along the outer side surfaces 59 and along the rear surfaces 58 and usually secured to back surface 58 by a plurality of staples 63 (FIG. 7). Canvas art 61 can be attached to the frame members by an adhesive or other attachment means. The frame members 56 will form four inner right angle corners 65 at the junction of the top, bottom and side frame members as shown in FIG. 7.

Figure 4:
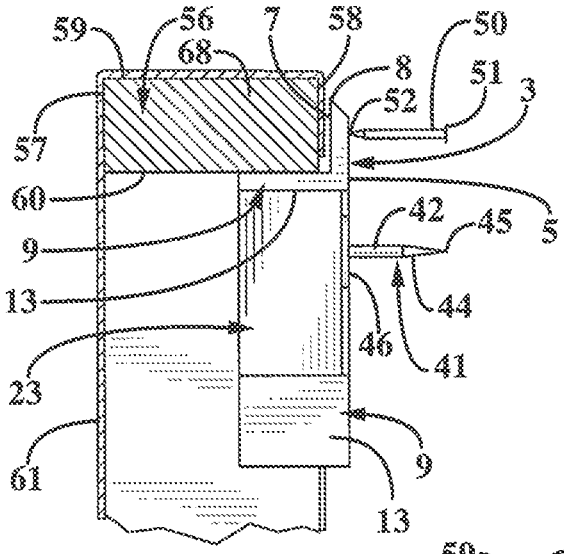
FIGS. 4 and 5 show the bracket being attached to a frame which is shown in section.

Bracket 1 is installed by laying the bottom surface 7 thereof and in particular, the V-planar portion 19 along and on top of rear surfaces 58 of the adjacent frame members 56 which form the two upper right angled corners pressing the V-shape angle formed by legs 9 tightly against the inner side surfaces 61 as shown in FIG. 4. Pressure is then applied downwardly on the V-shaped planar portions 33 followed by the subsequent pressing or driving of securement pins 50 through holes 29 and into the frame as shown in FIGS. 4 and 5. Securement pins 50 firmly affix bracket 1 onto frame 55 tightly secured within the upper two right angle corners 65 thereof as shown in FIG. 7.

Figure 8:
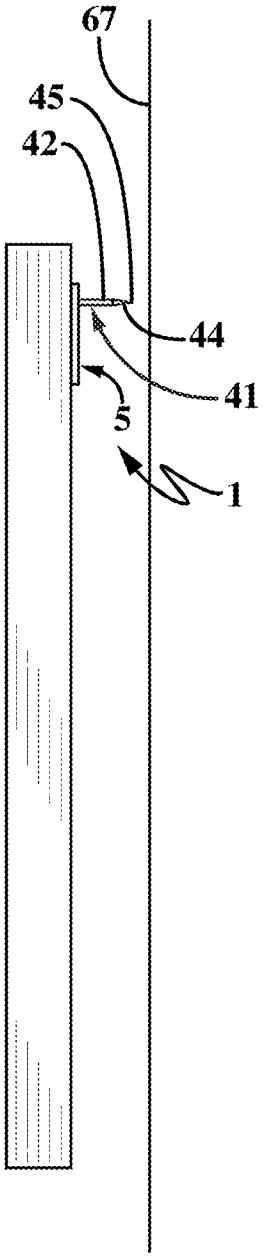
FIG. 8 is a side view of the canvas art just before being attached to a supporting structure.

With two brackets 1 in their attached position on frame 55, the frame is placed adjacent a wall 67 or other support structure as shown in FIG. 8, and pressed firmly thereagainst in the direction of Arrow B. This presses pointed ends 45 of attachment pins 41 into the support structure as shown in FIG. 8. Pins 41 will support frame 55 on and substantially flush against the surface of wall 67 with no additional hardware being required or visible as with prior canvas art hardware hangers or brackets.

Thus, a canvas painting or artwork 61 is easily mounted on a wall requiring only two small puncture holes therein caused by pointed ends 45 and shafts 42 of attachment pins 41. Pins 41 are easily installed on the back of the canvas painting requiring only the driving or forcing of the two small securement pins 50 into the frame once the angled legs or flanged areas of the bottom surface of the bracket are placed along the inner frame surfaces as shown in FIG. 4 after pressing legs 9 against the inner surfaces 60 of the frame members which form the two upper right-hand angled corners.

As shown in FIG. 6, the size of the height and depth of another frame member 68 can vary appreciably from that of the frame member as shown in FIGS. 4 and 5, without affecting the size and method of installing two corner brackets 1 on the upper two right-angled corners of the frame. The only feature required is that the length or height H of legs 9 be at least equal to or less than the height or thickness of the bracket 68, as shown by side surfaces 59 and 60 in FIGS. 4 and 5. Thus, a single size of bracket 1 will easily fit and be used with nearly all sizes of wooden frames constructed for use with canvas art. In the event that the canvas frame is of a considerable size and weight, the overall size of bracket 1 can be increased as needed to support a greater weight than most sizes of canvas art.

Also, bracket 1 preferably is easily and inexpensively molded of a plastic material requiring only the formation of two holes 29 therein in which pins 50 may be subsequently installed, usually with a friction fit so as to remain attached to the bracket until it is necessary to drive them through bracket holes 29 and into the wooden frame as shown in FIGS. 4 and 5, or with pins 50 being packaged with bracket 1 unsecured in holes 29. This frictional fit of pin 50 in holes 29 eases the installation of the bracket on the picture frame eliminating loss or misplacement of pins 50. Also, the only other manufacturing step required is the embedding of attachment pin 41 within hole 37 which can easily be accomplished by a force fit or staking of pin 41 in hole 37 when molding of bracket 1 where it is securely held due to the irregular or knurled surface 43 at the opposite end from pointed end 45.

Also, as shown in FIGS. 4-7, one of the legs 9 of each bracket 1 functions as a shelf for supporting the frame thereon with the other leg 9 functioning as a guide for positioning bracket 1 within a respective right angled corner of the frame.

A second embodiment of the picture hanging bracket of the present invention is indicated generally at 70, and is shown in FIGS. 10-13. Hanging bracket 70 is similar to that of bracket 1 discussed above in that it includes bottom surface 7, legs 9 extending outwardly therefrom which form a right angled corner and forms v-shaped planar portion 19 in which two holes 29 are formed adjacent the outer ends thereof for receiving securement pins 50 or other type fasteners as discussed with bracket 1 above. It also includes a rib 71 extending between legs 9 having an enlarged or reinforced area such as column 72 formed integrally therewith and extending downwardly from a triangular-shaped web 73 extending between rib 71 and planar surfaces 33 of top surface 5 as in bracket 1.

Figure 10:
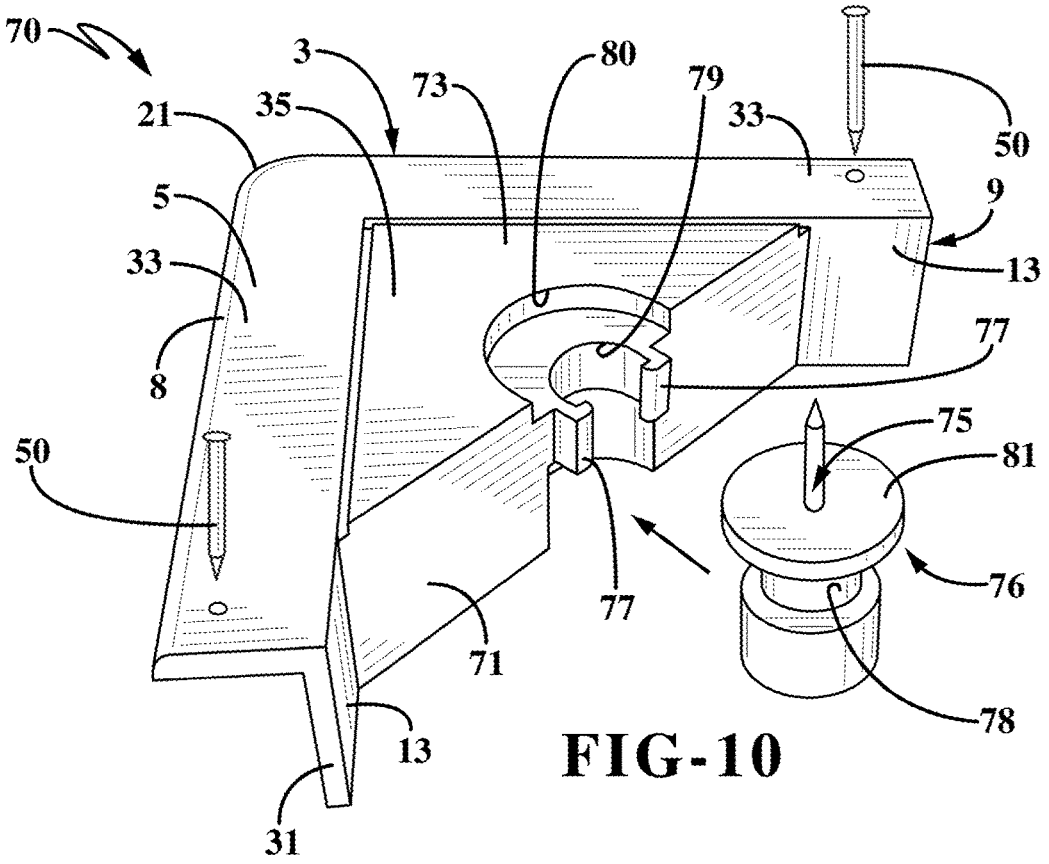
FIG. 10 is an exploded top perspective view of a second embodiment of the picture hanging bracket of the present invention.
Figure 11:
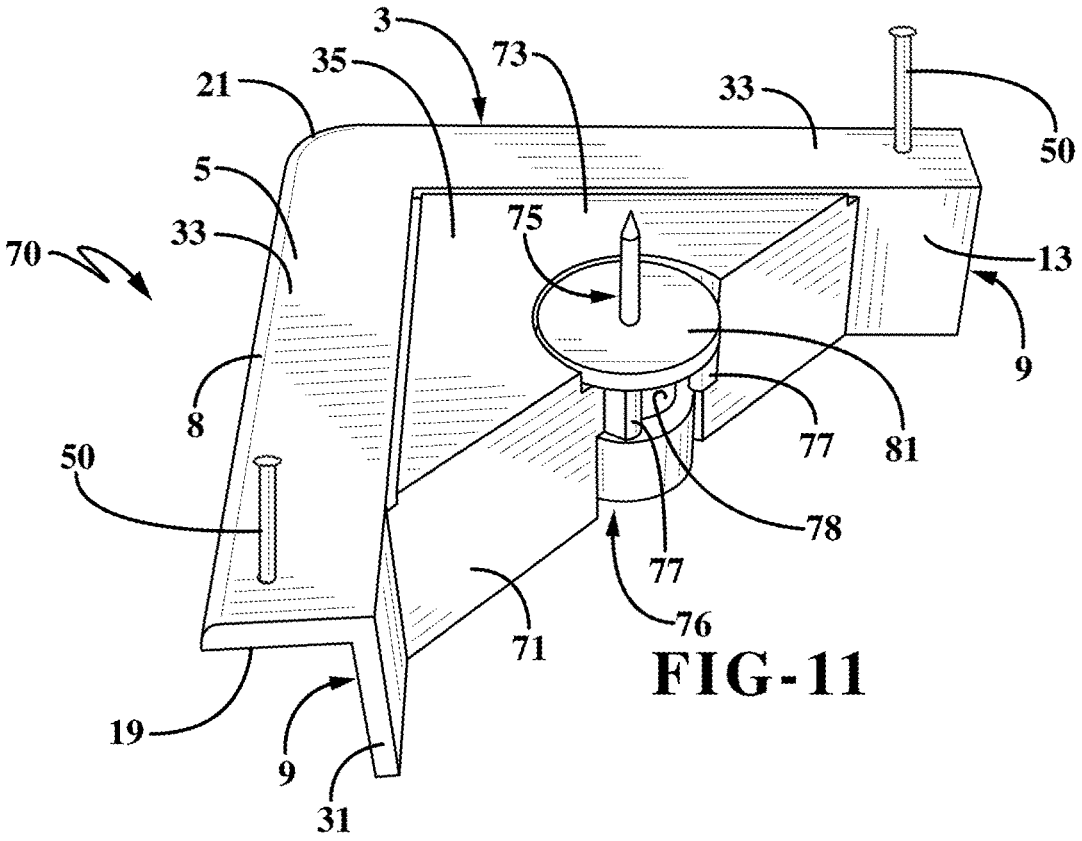
FIG. 11 is a top perspective view showing the bracket of FIG. 10 in assembled condition ready for installing on a picture frame.
Figure 12:
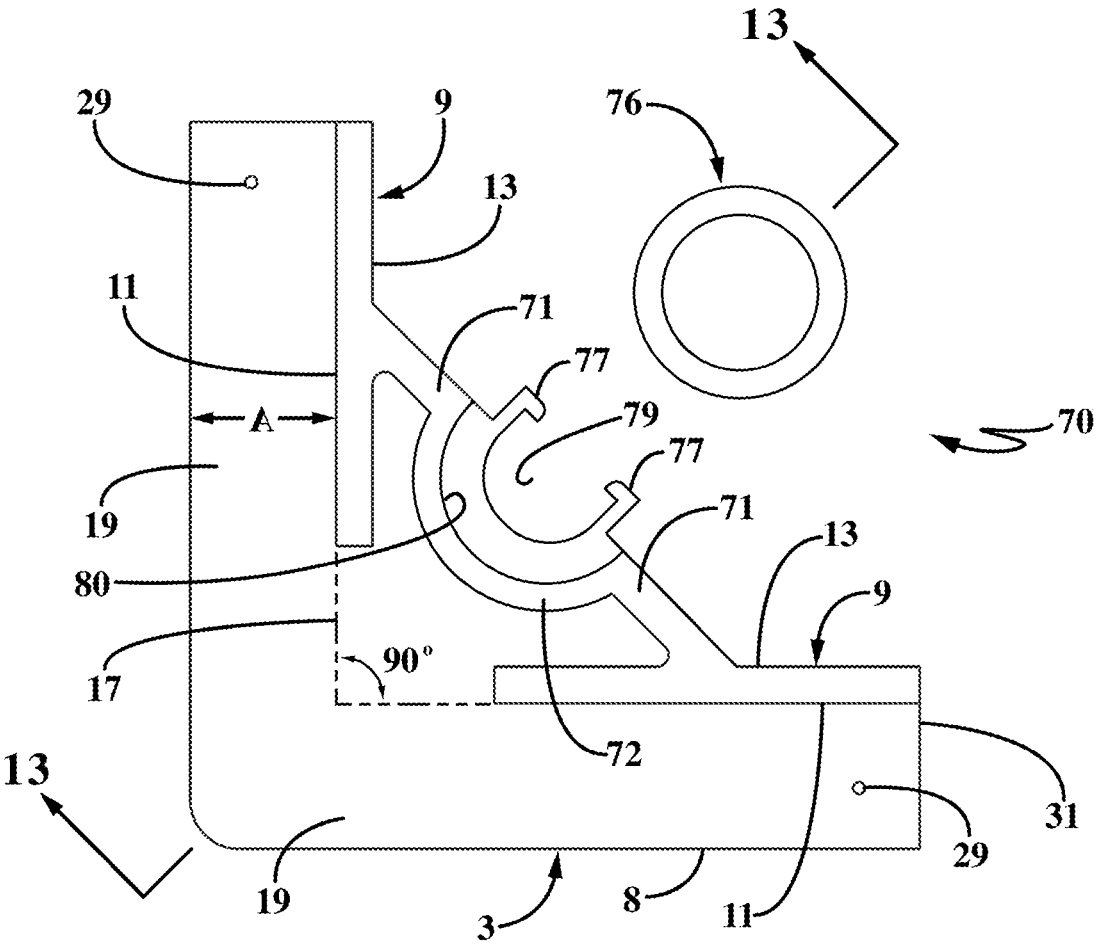
FIG. 12 is an exploded bottom plan view of the second embodiment of FIGS. 10 and 11.
Figure 13:
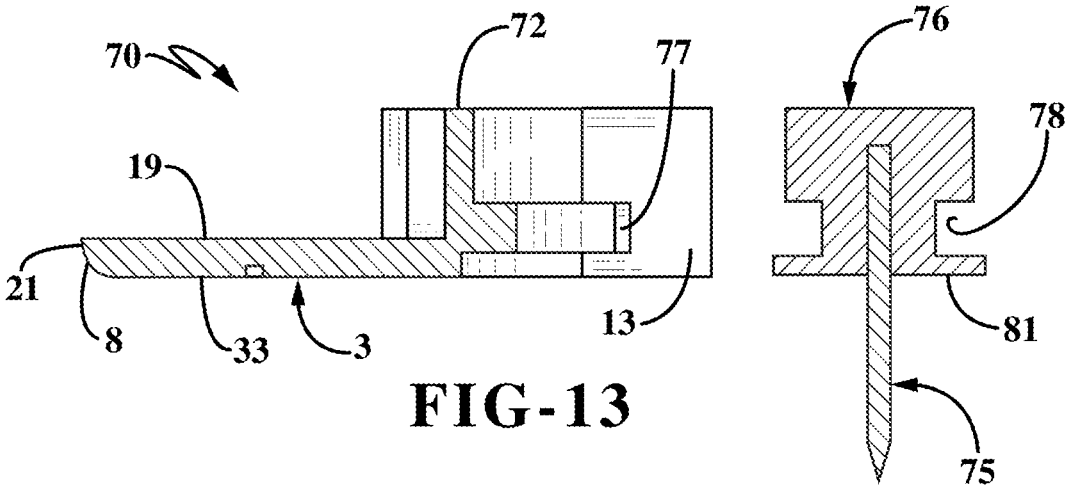
FIG. 13 is a sectional view taken on line 13-13, FIG. 12.

The main difference between bracket 70 and bracket 1 is that the attachment pin 75 is embedded in a cylindrical shaft indicated generally at 76, which is removably mounted between a pair of snap fingers 77 as shown in FIGS. 10 and 12. Cylindrical shaft 76 preferably is formed with an annular channel 78 in which snap fingers are engaged as shown in FIG. 11 to retain shaft 76 in a semi-circular opening 79 formed between the snap fingers in web 73 and reinforcing column 72. Web 73 preferably is formed with a generally semi-circular depression 80 which receives the circular disc-shaped top portion 81 of cylindrical shaft 76 as shown in FIG. 11.

This removable mounting of attachment pin 75 of bracket 70 enables the pin to be stored in the body of the hanger during transport and prior to set up and also allows a number of other items to be clipped and stored in the same package, for example a wall-marking device or a cavity to accept the head or hanging hardware such as a deco nail or deco screw etc. Likewise, securement pins 50 can be packaged in the same package with attachment pin 75.

Figure 9:
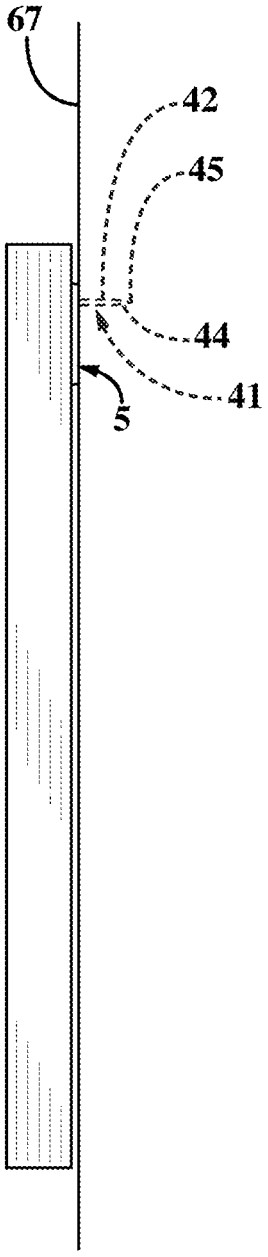
FIG. 9 is a view similar to FIG. 8 showing the canvas art completely attached to the supporting structure.

Thus, bracket 70 is secured in the same manner as bracket 1 in the upper two right hand corners of a picture frame as shown in FIG. 7 and discussed above, and secured therein by securement pins 50 or other type of fasteners, afterwhich shaft 76 containing attachment pin 75 is snap-fitted in position as shown in FIG. 11 and then secured to a supporting structure by a pair of attachment pins 75 in the same manner as that described above and shown in FIGS. 8-9.

This arrangement of removably mounting attachment pin 75 in the base 3 of bracket 70 has a number of other advantages including the ability to modify certain dimensions and profiles of the hanger body so that the variations become an effective solution for not only canvas art, but picture frames made of wood and metal. This also provides the ability that the various elements can be combined in different ways to create solutions for different hanging and frame scenarios.

A third embodiment of the picture hanging bracket of the present invention is indicated generally at 85, and is shown in FIGS. 14-17. Bracket 85 is similar to that of brackets 1 and 70 discussed above in that it has the same right angle forming legs 9 and V-shaped bottom planar portion 19 and holes 29 for receiving a pair of securement pins 50 or other type fasteners for securing the bracket in a selected right angle corner of a picture frame. The main difference of bracket 85 with respect to bracket 70 is that a circular hole 86 is formed in a reinforcing column 97 similar to that of reinforcing columns 27 and 72 discussed above, which extends from the bottom surface of a triangular web 95 extending between legs 9 and planar surfaces 33 of the bracket in a similar manner as reinforcing column 72 of bracket 70.

A reinforcing rib preferably extends between legs 9 and is integrally formed with web 95 and the reinforcing column 97 in a similar manner as ribs 23 and 71 discussed above. Circular hole 86 is formed with a pair of diametrically opposed arcuate interior channels 87 formed in cylindrical side wall 88 which forms hole 86, which channels communicate with a pair of small axially extending channels 89. A cylindrical plug 90 has a pair of nubs 92 extending diametrically opposite from each other and has an attachment pin 93 embedded therein and extending axially from the center of plug top surface 94.

Figure 14:
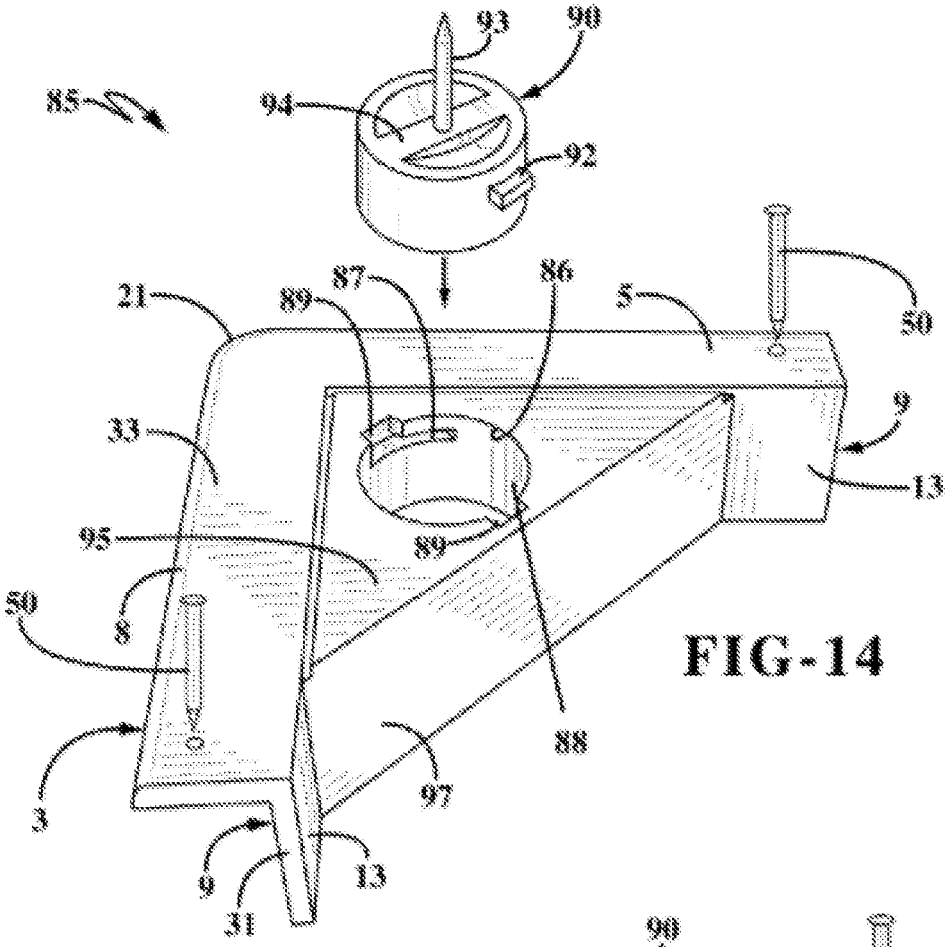
FIG. 14 is an exploded top perspective view of a third embodiment of the picture hanging bracket of the present invention.
Figure 15:
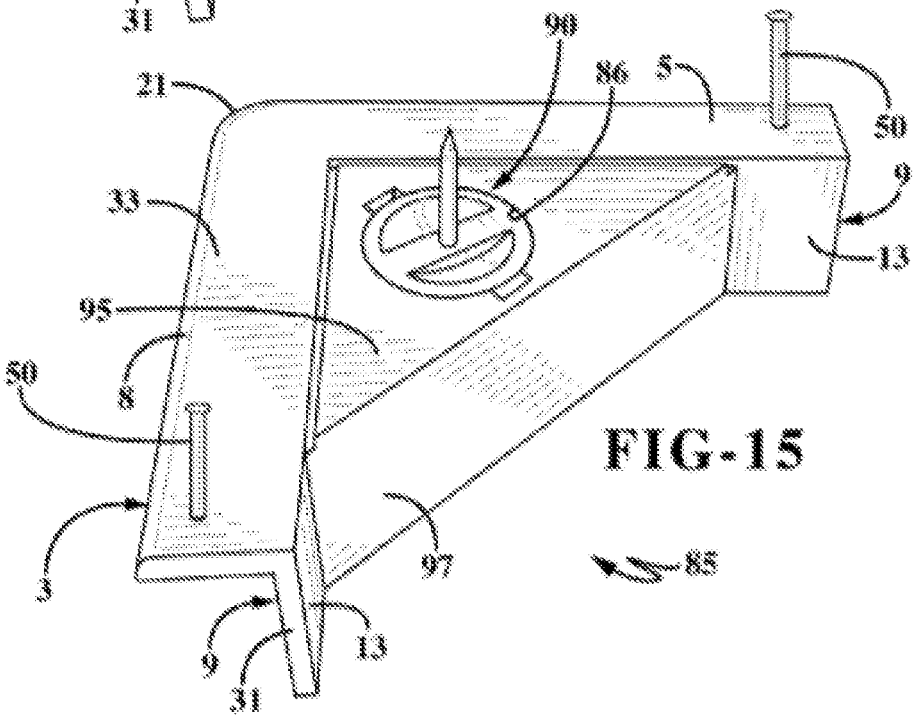
FIG. 15 is a top perspective view of the picture hanging bracket of FIG. 14 in assembled condition.
Figure 16:
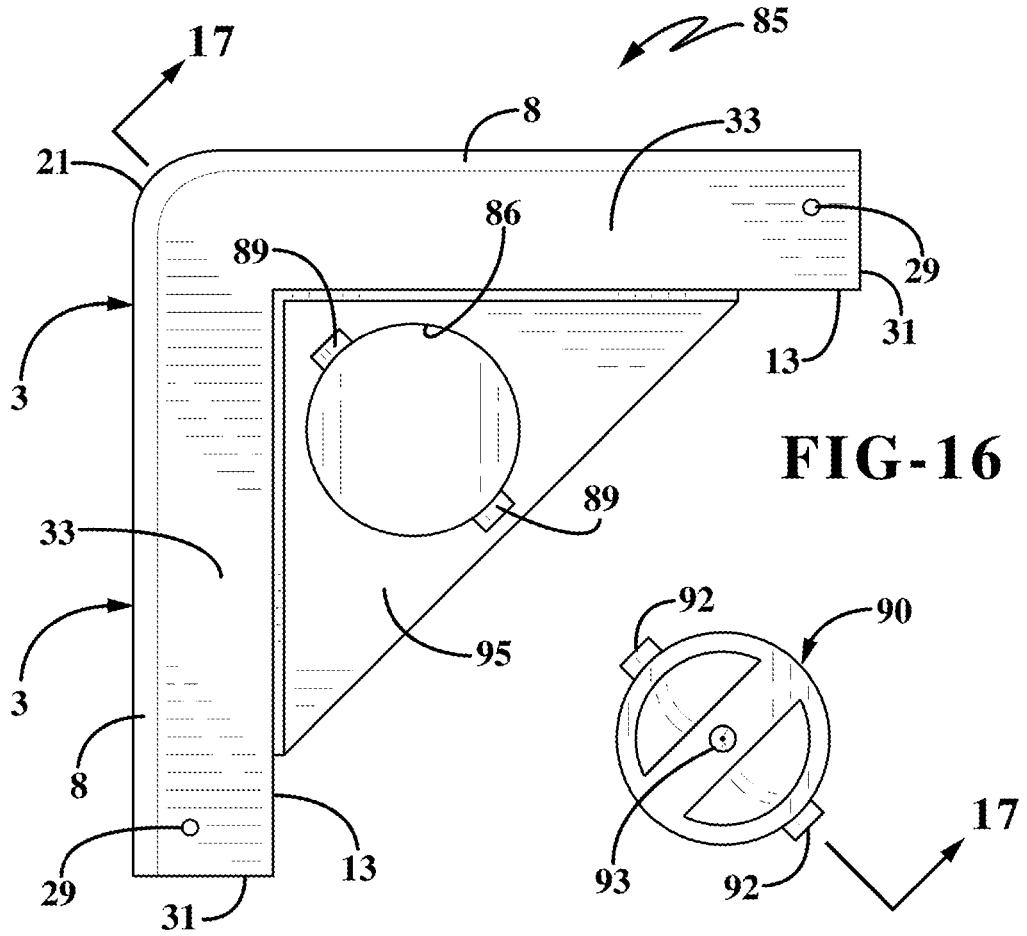
FIG. 16 is an exploded top plan view of the third embodiment of the picture hanging bracket of FIGS. 14 and 15.
Figure 17:
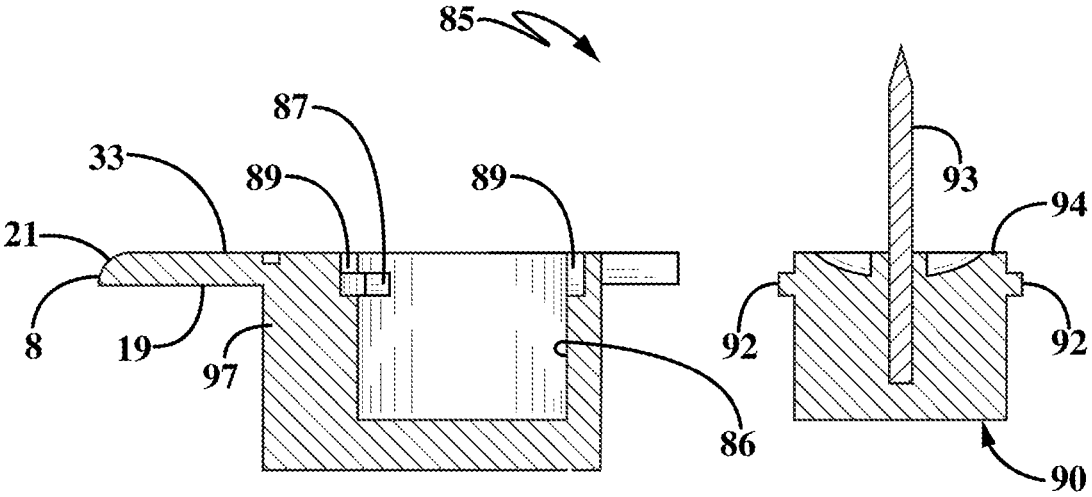
FIG. 17 is a sectional view taken on line 17-17, FIG. 16.

Plug 90 is removably mounted in circular hole 86 by slidably inserting nubs 92 into axial channels 89 afterwhich the plug is rotated in a clockwise direction when viewing FIG. 14 whereby the nubs slide into arcuate channels 87 to secure plug 90 within hole 86.

This construction again enables attachment pin 93, and in particular plug 90, together with securement pins 50, to be packaged in a separate package or attached in a convenient manner to the body of bracket 85 for storage and shipment. Plug 90 is easily inserted and secured within hole 86 prior to or after the bracket has been secured to the picture frame by securement pins 50 in the same manner as discussed above with respect to brackets 1 and 70. Bracket 85 provides a different embodiment for removably attaching the attachment pin to the bracket than that of the snap-fit construction of shaft 76 of bracket 70. The remaining features of bracket 85 are the same as that of brackets 1 and 70 with respect to the bottom surface thereof which includes the right angle forming legs 9 which form V-shaped planar portion 19 terminating in apex 21.

A fourth embodiment of the picture hanging bracket of the present invention is indicated generally at 100, and is shown in FIGS. 18-22. Bracket 100 is similar to that of brackets 1, 70 and 85 discussed above in that it includes the same right angle forming legs 9, V-shaped planar portion 19, peripheral edge 8, securement pin-receiving holes 29, securement pins 50, or other type fasteners, etc. A reinforcing rib 103, triangular-shaped web 104 and reinforcing column 108 similar to that described above with respect to brackets 70 and 85 and webs 73 and 95 are formed on and extend outwardly from the bottom surface of the bracket and web 104.

Figure 20:
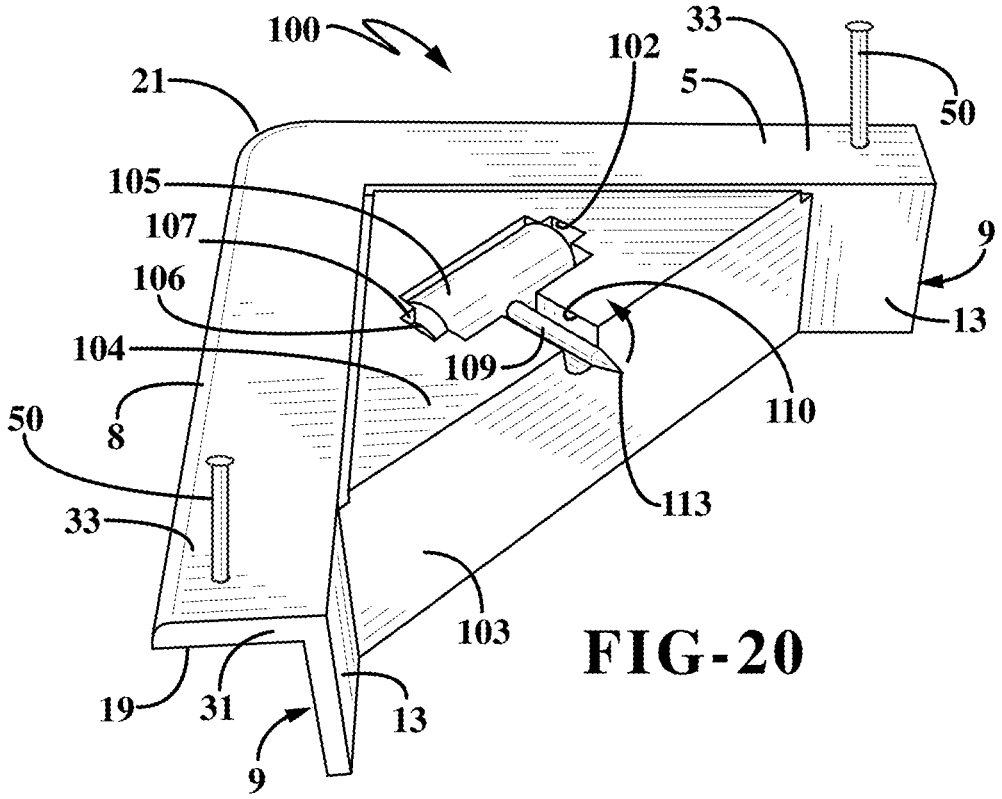
FIG. 20 is a top perspective view similar to FIG. 19 with the attachment pin in a retracted position.
Figure 21:
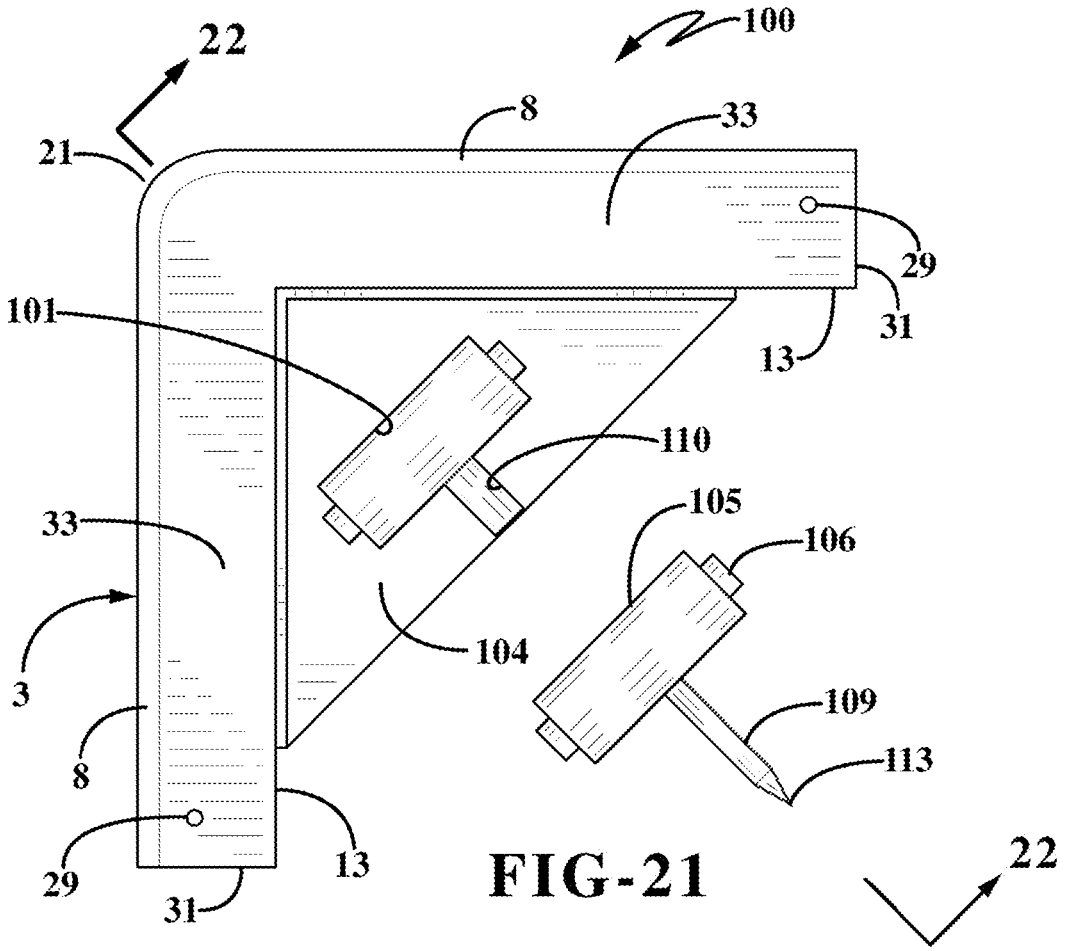
FIG. 21 is an exploded top plan view of the picture hanging bracket of FIG. 18.
Figure 22:
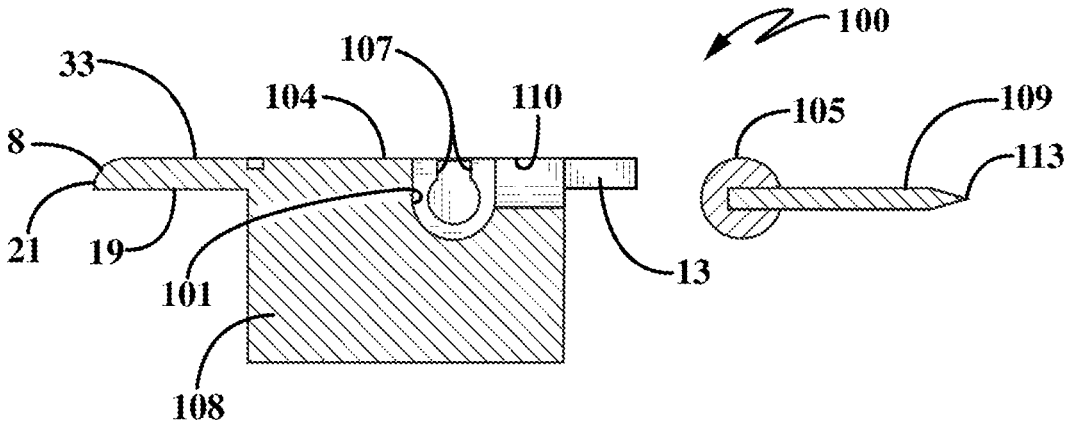
FIG. 22 is a sectional view taken on line 22-22, FIG. 21.

An elongated semi-cylindrical opening 101 is formed in web 104 and reinforcing column 108 and terminates in reduced semi-circular counterbores 102. A cylindrical shaft indicated generally at 105 is adapted to be snap-fitted into opening 101 and secured therein by a pair of reduced diameter shaft ends 106 which are received into counterbores 102 formed in the reinforcing column and triangular web 104. A pair of shoulders 107 are formed at the top openings of counterbores 102 for receiving shaft ends 106 in a snap-fit engagement, which rotatably mounts shaft 105 within cylindrical opening 101. An attachment pin 109 is embedded in shaft 105 and extends outwardly therefrom in a direction perpendicular to the rotational axis of shaft 105, and when in a retracted position as shown in FIG. 20 lies in a slot 110 formed in the top surface of web 104 and the outer surface of the diagonally extending reinforcing rib 103.

Figure 18:
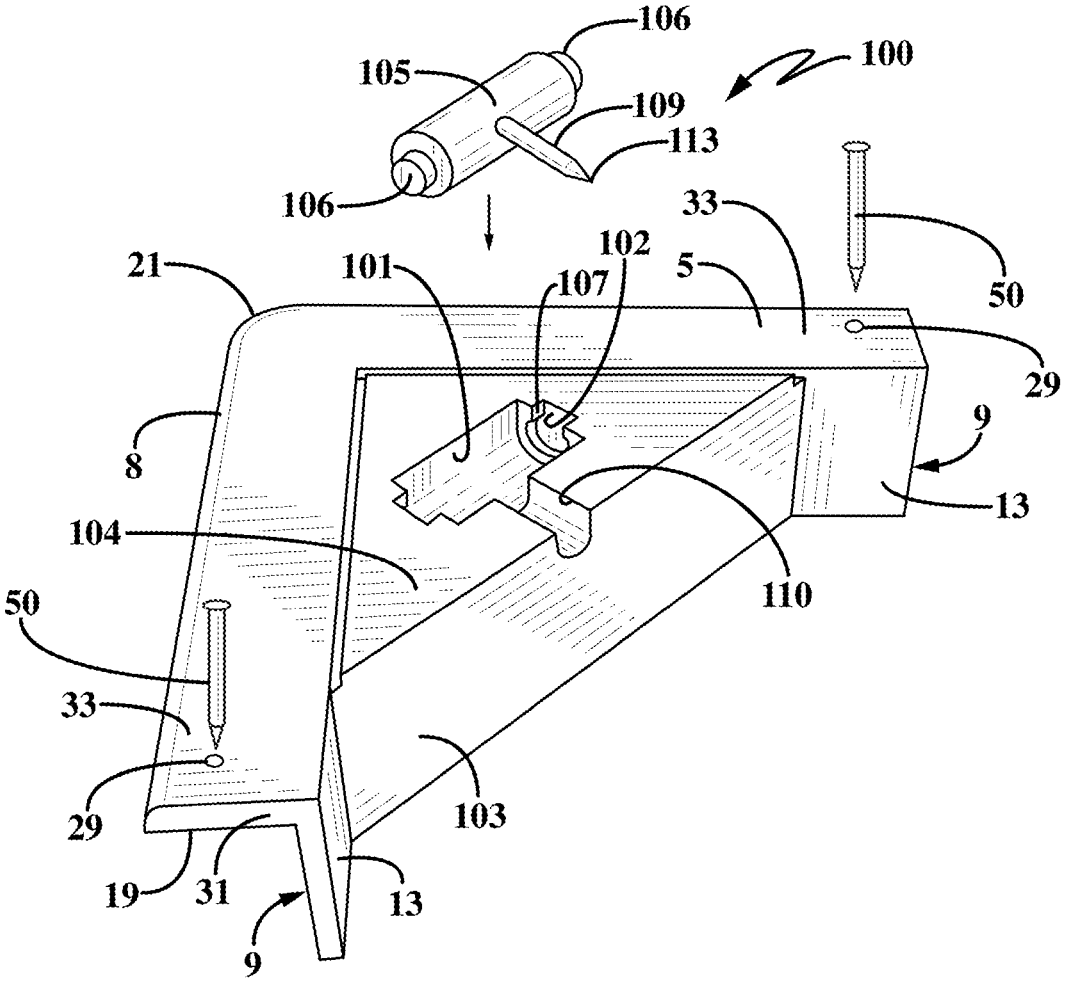
FIG. 18 is an exploded top perspective view of a fourth embodiment of the picture hanging bracket of the present invention.
Figure 19:
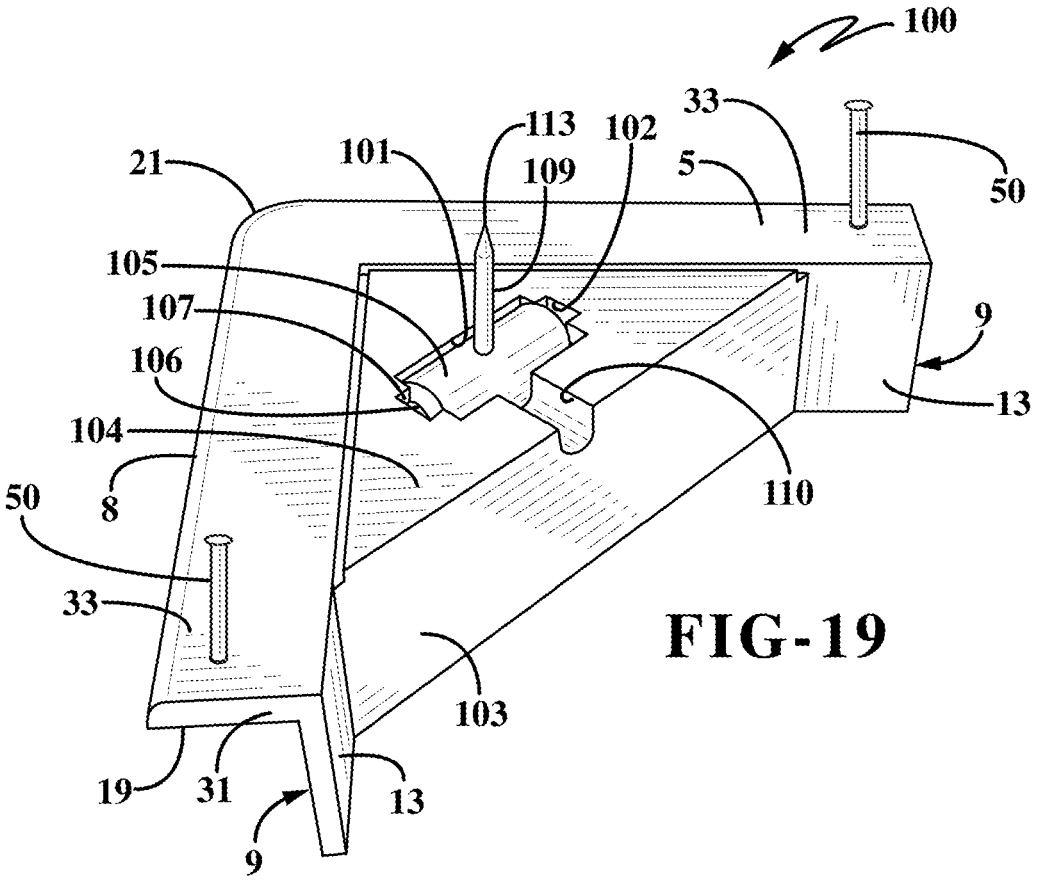
FIG. 19 is a top perspective view of the picture hanging bracket of FIG. 18 in assembled condition with the attachment pin in an extended position.

The construction of bracket 100 is similar to that of brackets 70 and 85 in that it enables the attachment pin 109 to be packaged and shipped detached from the bracket body and then removably secured in the bracket body just prior to or after the bracket has been secured to the picture frame by securement pins 50. Also if desired, shaft 105 can be rotatably mounted in the bracket body as shown in FIG. 20 for shipment and then pivoted to the extended position of FIG. 19 by the user thereof without having to be attached to the bracket body by the user as shown in FIG. 18. Also if desired, the length of slot 110 and attachment pin 109 can be adjusted so that the pointed end 113 thereof will not extend beyond the outer surface of rib 103 and is completely protected within the surrounding material of web 104 and rib 103 to eliminate any sharp protrusion for packaging and shipping the bracket in assembled condition.

Brackets 70, 85 and 100 are attached to a frame by various type fasteners including adhesives, and to a support structure in the same manner as described above for bracket 1. Likewise, they are preferably molded of a plastic material in various sizes and thicknesses for use with various sizes and weights of objects, and in particular picture frames.

Again, as with bracket 1, one of the legs 9 extending from the bottom surface 7 of the base will function as a shelf for supporting the picture frame thereon with the other leg 9 functioning to position the bracket in a respective right angled corner of the object to be supported by a pair of brackets.

Brackets 70, 85 and 100 provide the additional advantage of improved packaging and shipment of the brackets and interchangeable components.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A bracket for mounting an object to a support structure, the bracket comprising: a base having first and second surfaces terminating in an edge, the base being configured for being secured to the object, a generally semicircular opening leading to a pair of snap fingers; and an attachment pin extending outwardly beyond the second surface for attaching the bracket, with the object secured thereto, to the support structure, the attachment pin being mounted in and extending outwardly from a shaft, the shaft being snap-fitted into the semicircular opening and retained therein by the snap fingers, a pair of outer side walls projecting perpendicularly from the first surface and extending at right angles with respect to each other, each of the outer side walls being spaced from the edge of the base; and a reinforcing member extending between the outer side walls, the generally semicircular opening being provided in the reinforcing member.

2. The bracket defined in claim 1, comprising at least one fastener engageable with a planar portion of the base for securing the bracket to the object, the at least one fastener having a pair of securement pins; in which a pair of through holes are formed in the planar portion of the base for moveably mounting a corresponding one of the securement pins within each of said through holes; and in which the attachment pin is located between the through holes.

3. The bracket as defined in claim 1, wherein the second surface of the base has a V-shaped planar portion; in which a recessed web extends between said V-shaped planar portion; and in which the attachment pin extends outwardly from said web and beyond the second surface of the base.

4. The bracket as defined in claim 1, wherein the bracket is a one-piece member molded of a plastic material.

* * * * *